US011786950B2

(12) United States Patent
Cmiel et al.

(10) Patent No.: US 11,786,950 B2
(45) Date of Patent: Oct. 17, 2023

(54) METHOD FOR CHANGING THE CALLIBRATION RANGE OF A DRAWING CHAIN, COMPRISING CHAIN LINKS, OF A CATERPILLAR-TRACK DRAWING MACHINE, AND CATERPILLAR-TRACK DRAWING MACHINE

(71) Applicant: SMS group GmbH, Duesseldorf (DE)

(72) Inventors: Thomas Cmiel, Moenchengladbach (DE); Joerg Lindbuechl, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 41 days.

(21) Appl. No.: 17/420,269

(22) PCT Filed: Dec. 2, 2019

(86) PCT No.: PCT/DE2019/101031

§ 371 (c)(1),
(2) Date: Jul. 1, 2021

(87) PCT Pub. No.: WO2020/141005

PCT Pub. Date: Jul. 9, 2020

(65) Prior Publication Data

US 2022/0088659 A1 Mar. 24, 2022

(30) Foreign Application Priority Data

Jan. 4, 2019 (DE) ..... 10 2019 100 142.0
Mar. 13, 2019 (DE) ..... 10 2019 106 362.0

(51) Int. Cl.

| | |
|---|---|
| ***B21C 1/30*** | (2006.01) |
| ***B21C 1/28*** | (2006.01) |
| ***B21C 1/20*** | (2006.01) |

(52) U.S. Cl.
CPC ..... *B21C 1/28* (2013.01); *B21C 1/20* (2013.01); *B21C 1/30* (2013.01)

(58) Field of Classification Search
CPC .... B21C 1/20; B21C 1/22; B21C 1/28; B21C 1/30; B21C 1/305; B65G 15/14; B65G 17/10; B65H 51/14
See application file for complete search history.

(56) References Cited

U.S. PATENT DOCUMENTS 1,904,885 A * 4/1933 Seeley ..... B65H 51/14 198/301
2,251,291 A * 8/1941 Reichelt ..... B65H 51/14 24/535

(Continued)

FOREIGN PATENT DOCUMENTS

DE 10 2018 111 731 A1 11/2018
EP 2 197 601 B1 3/2011

(Continued)

OTHER PUBLICATIONS

International Search Report in PCT/DE2019/101031, dated Mar. 10, 2020.

*Primary Examiner* — Edward T Tolan
(74) *Attorney, Agent, or Firm* — Collard & Roe, P.C.

(57) ABSTRACT

In the case of a caterpillar track drawing machine having a drawing die and a caterpillar track disposed behind the drawing die, which track comprises two drawing chains having drawing tools disposed on chain links of the drawing chains, it should be possible to align the drawing tools of at least one of the two drawing chains jointly with the respective chain link, perpendicular to the drawing line, so that the caliber range can be changed, in simple and operationally reliable manner, between two drawing recesses having different caliber ranges. The latter is also possible if two different drawing recesses of the second one of the two (Continued)

Figure 1:
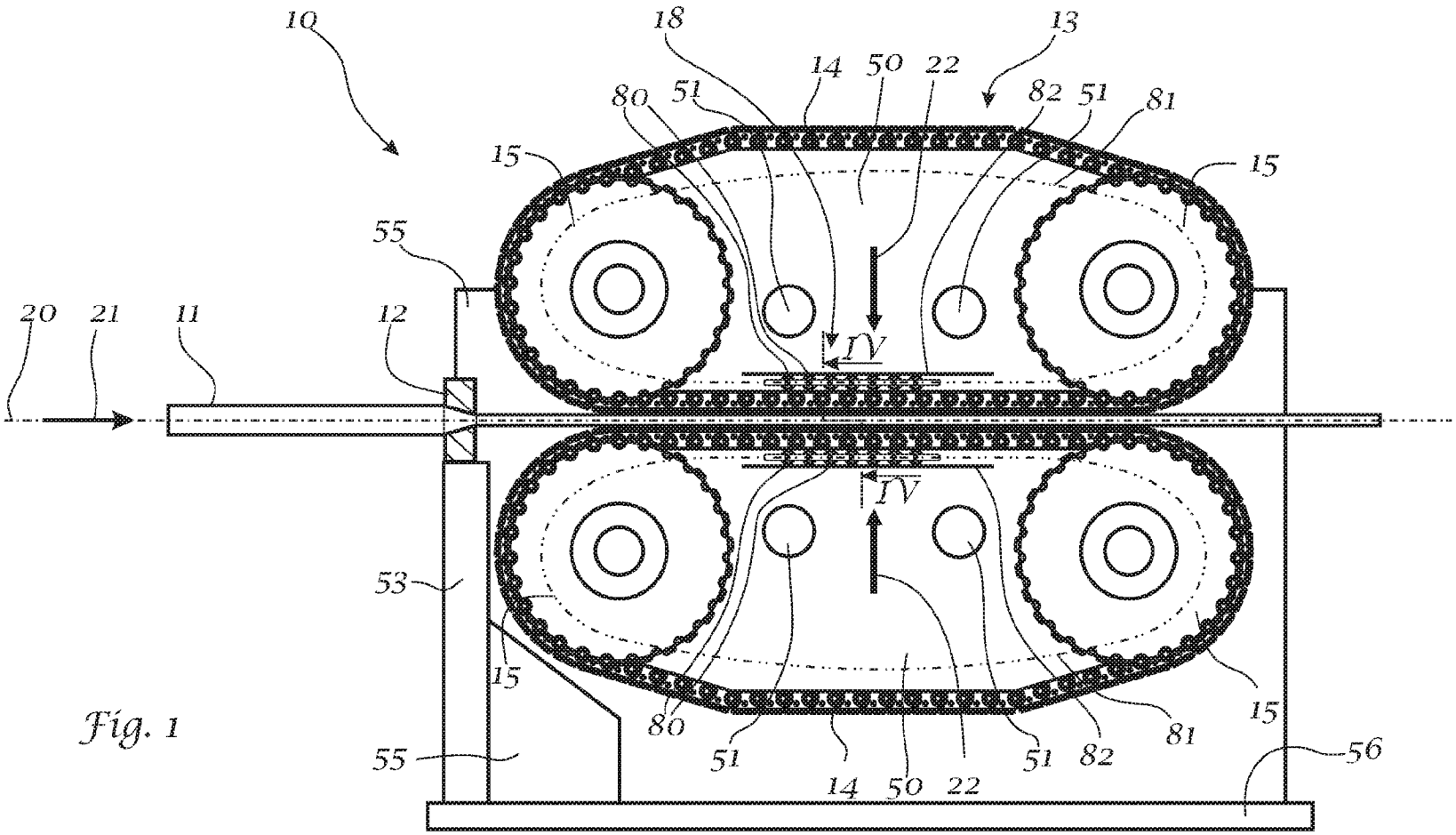

drawing chains are intended for a first caliber range for which the first drawing recesses for at least one of the two drawing chains are intended, or if the drawing recesses of a first one of the two drawing chains deviate from the drawing recesses of a second one of the two drawing chains.

19 Claims, 10 Drawing Sheets

(56) References Cited

U.S. PATENT DOCUMENTS 2,797,798 A * 7/1957 Hallden ..... B21C 1/30 226/172
2,884,120 A * 4/1959 Bruestle ..... B21C 19/00 226/172
3,567,095 A * 3/1971 Geist ..... B65G 15/42 226/172
3,668,916 A * 6/1972 Ledebur ..... B21C 51/00 72/274
4,013,205 A * 3/1977 Fabre-Curtat ..... B65H 51/14 226/173
4,235,362 A * 11/1980 Hubenko ..... B21F 23/002 226/193
5,326,010 A * 7/1994 Moras ..... B21C 1/30 226/170
6,173,769 B1 * 1/2001 Goode ..... E21B 19/22 226/173
6,644,467 B1 * 11/2003 Chiuch ..... B21C 1/30 198/626.1
6,880,629 B2 * 4/2005 Schroeder ..... E21B 19/22 166/380
7,743,911 B2 6/2010 Kudrus
7,770,430 B2 8/2010 Miceli et al.
7,937,980 B2 5/2011 Hessberger et al.
7,942,030 B2 5/2011 Miceli et al.
9,156,073 B2 * 10/2015 Wang ..... B21C 37/083
9,676,016 B2 * 6/2017 Stewart ..... B21C 1/22
10,167,140 B2 * 1/2019 Eichner ..... B65H 51/14
10,392,875 B2 * 8/2019 Basler ..... E21B 19/22
2009/0045158 A1 2/2009 Suriol
2016/0288182 A1 10/2016 Della Rossa et al.
2018/0339328 A1 11/2018 Cmiel et al.

FOREIGN PATENT DOCUMENTS

JP 2 717 383 B2 2/1998
JP H10-277631 A 10/1998
JP 2 986 758 B2 12/1999
SU 676346 A1 7/1979
WO 2005/092533 A1 10/2005
WO 2006/002613 A1 1/2006

* cited by examiner

METHOD FOR CHANGING THE CALLIBRATION RANGE OF A DRAWING CHAIN, COMPRISING CHAIN LINKS, OF A CATERPILLAR-TRACK DRAWING MACHINE, AND CATERPILLAR-TRACK DRAWING MACHINE

CROSS REFERENCE TO RELATED APPLICATIONS

This application is the National Stage of PCT/DE2019/101031 filed on Dec. 2, 2019, which claims priority under 35 U.S.C. § 119 of German Application Nos. 10 2019 100 142.0 filed on Jan. 4, 2019 and 10 2019 106 362.0 filed on Mar. 13, 2019, the disclosures of which are incorporated by reference. The international application under PCT article 21(2) was not published in English.

The invention relates to a method for changing the caliber range of a drawing chain of a caterpillar track drawing machine that comprises chain links, as well as to a caterpillar track drawing machine.

The invention relates, in particular, to a caterpillar track drawing machine comprising a drawing die and a caterpillar track disposed behind the drawing die, viewed in a drawing direction, as this is disclosed, for example, in JP 2 717 383 B2, WO 2006/002613 A1 or WO 2005/092533 A1. In this regard, the caterpillar track can draw a workpiece through a drawing die along a drawing line aligned parallel to the drawing direction, shaping it, and, for this purpose, comprises two circulating chain links and drawing tools arranged or configured, which can grip the workpiece and draw it through the drawing die in accordance with the circulating movement of the drawing chains of the caterpillar track. In general, in this regard, the drawing tools or the drawing chains circulate parallel to or in a drawing plane that intersects the drawing line.

As can be derived, in particular, from JP 2 986 758 B2, EP 2 197 601 B1 or also DE 10 2018 111 731 A1, the drawing recesses are adapted, at least within certain limits, to the cross-section of the workpiece to be drawn, in each instance. This serves for being able to grip the respective workpieces securely, without damaging the workpiece in this process.

In order to apply the required gripping forces, the respective drawing tools are pressed against one another in a gripping region with the required force, for example by way of corresponding press-down bars, which carry press-down rollers, and, if necessary, by way of idle rollers that also circulate, wherein it is assumed that the press-down forces need to be approximately ten times as great as the drawing forces that the caterpillar track must apply for shaping drawing of the workpiece through the drawing die. Depending on the concrete conditions, a specific shape of a drawing recess allows a specific caliber range of workpiece cross-sections, which can be grasped in operationally reliable manner using the corresponding drawing recess.

For this reason, EP 2 197 601 B1 and DE 10 2018 111 731 A1 disclose drawing tools having two or more drawing recesses, which are configured, differently, in each instance, and therefore are intended for different caliber ranges. By means of displacement of the drawing tools, which are held in tool holders that are formed on the chain links, in each instance, with reference to these tool holders, the drawing recesses can be aligned, in each instance, perpendicular to the drawing line or to the drawing plane, optionally with reference to the drawing line or the drawing plane. This then makes it possible that the caliber range of the drawing chain or the individual drawing recesses can be changed accordingly, in that the drawing tools are displaced accordingly with reference to the respective chain links.

It is the task of the present invention to make available such a caliber changing method as well as such a caterpillar track drawing machine, in which method or machine the caliber range of the drawing chain or of the drawing chains can be changed easily and in operationally reliable manner.

The task of the invention is accomplished by means of a caliber changing method for changing the caliber range of a drawing chain of a caterpillar track drawing machine, which chain comprises chain links, as well as by means of a caterpillar track drawing machine, having the characteristics of the independent claims. Further advantageous embodiments, if applicable also independent of these, are found in the dependent claims and in the following description.

In particular, in the case of a caliber changing method, the drawing tools that comprise the first and second drawing recesses and are disposed on the chain links of the drawing chain of the caterpillar track can be aligned jointly with the chain link. In this way, the caliber range of the drawing chain or of the drawing chains can be changed easily and in operationally reliable manner, since the drawing tools can be aligned jointly with the respective chain link, with reference to the drawing line or to the drawing plane, in such a manner that the two drawing recesses are aligned accordingly with reference to the drawing line, as is desired for drawing a specific workpiece.

Because of the fact that the drawing tools do not have to be aligned independently of the respective chain links that carry the corresponding drawing tools, the drawing tools do not have to be released from the related chain links before being aligned, and to not have to be connected with them again after being aligned.

Accordingly, it is also advantageous, also in the case of a caterpillar track drawing machine, if the drawing tools of at least one of the two drawing chains of the caterpillar track that belongs to the caterpillar track drawing machine can be aligned perpendicular to the drawing line jointly with the respective chain link. By means of a displacement of the chain links jointly with the drawing tools, the caliber range of the drawing chain or of the drawing chains can thereby be changed in simple and operationally reliable manner.

For this purpose, it is conceivable, in particular, that the entire drawing chain is displaced or aligned accordingly, as a whole; this can take place, for example, in that the drawing chain is displaced accordingly at a local location, for example at a chain wheel, while it is circulating, so that after one circulation or even after multiple circulations, a corresponding displacement has then taken place. In this regard, it is understood that in the case of a specific total displacement that is desired for alignment, the displacement can also take place successively in multiple individual steps, so that multiple circulations are required until the entire chain has then been displaced from a first alignment position, in which the respective first drawing recesses are aligned with reference to the drawing line, to a second alignment position, in which the second drawing recesses are aligned with reference to the drawing line. On the other hand, it is also conceivable, in particular, that the entire chain is displaced accordingly in one step, in that a chain support that carries the drawing chains and, if applicable, even the chain wheels around which the corresponding drawing chain is guided, are displaced jointly. Such displacement can take place, in particular, if the chain support and/or at least one of the chain wheels is/are displaced accordingly by means of an axial drive, or if the chain itself is actually still under tension. In this regard, it is not absolutely necessary to allow the drawing chain to circulate, since all the modules that stand in contact with the chain can actually be displaced axially in uniform manner, so that no great friction forces should occur here.

Simple and operationally reliable changing of the caliber range of the drawing chains can also be guaranteed if the drawing recesses of a first one of the two drawing chains deviate from the drawing recesses of a second one of the two drawing chains, or are disposed in deviating manner at their respective chain links, at least perpendicular to the drawing line. This also holds true if two different drawing recesses of the second one of the two drawing chains are intended for the first calibration range, for which the first drawing recesses of the at least one of the two drawing chains are intended. In the end result, this means that in this way, more complex arrangements of the drawing recesses of the first drawing chain relative to the drawing recesses of the second drawing chain are possible, so that in the case of given workpieces that are supposed to be drawn, the caliber with which the drawing tools ultimately grip the specific workpiece can be adapted as precisely as possible to the cross-section of the workpiece by means of the selection of a suitable combination of the drawing recesses of the first drawing chain with the drawing recesses of the second drawing chain, taking into consideration the respective distance of the drawing tools relative to the drawing line, so that gripping can take place without damage to the workpiece, if at all possible, but with sufficient forces. Such a detailed selection of the suitable caliber with which the respective workpieces can ultimately be gripped by the drawing tools, can be guaranteed, in this way, in simple and operationally reliable manner, in particular without a replacement of drawing tools being necessary. In this regard, a correspondingly great caliber range, in total, can be covered with a corresponding set of drawing tools for the two drawing chains, if applicable, if the respective drawing recesses on the drawing tools of the two drawing chains are selected in suitable manner.

In particular, the drawing tools and the respective chain links of the second drawing chain can be aligned with a direction component that deviates from the direction component with which the drawing tools and chain links of the first drawing chain are aligned. Thus, it can be conceivable to displace the drawing tools of the first drawing chain to the left with reference to a drawing plane that intersects the drawing line, while the drawing tools of the second drawing chain are displaced to the right with reference to the drawing plane, so as to obtain the desired pairing of drawing recesses of the first drawing chain and drawing recesses of the second drawing chain, which are aligned with reference to the drawing line, in each instance.

In this regard, it is assumed that in the end result, this relatively great flexibility also leads to the result that any wear that occurs will be distributed more uniformly over the expanse of the drawing tools or chain links, and also other modules of the caterpillar tracks, such as, for example, over the expanse of press-down bars or idle rollers, perpendicular to the drawing plane, in each instance, and thereby the period of use of the corresponding modules also increases.

In general, in the case of a caterpillar track drawing machine that comprises a drawing die and a caterpillar track disposed behind the drawing die, viewed in the drawing direction, a workpiece is drawn through the drawing die, shaping it, along a drawing line aligned parallel to the drawing direction. In comparison with other drawing machines, such as, for example, two-carriage drawing machines or circulating-roller drawing machines, in this way a very high drawing speed can be guaranteed at outstanding straightness of the workpieces to be drawn, wherein as a whole, such caterpillar track drawing machines prove to be comparatively complex and therefore cost-intensive due to the caterpillar tracks.

In order to represent a caterpillar track, the latter comprises at least one drawing chain having corresponding chain links, wherein the most varied types of chains, such as pure block chains, block/plate-link chains or pure plate-link chains, or also more complex chain arrangements composed of two parallel chains, among others, are already known as drawing chains from the state of the art.

Depending on the concrete embodiment of the interaction between the drawing tools and the workpieces drawn, in each instance, a caterpillar track can already bring about drawing of the workpiece with one drawing chain and merely with one set of corresponding drawing tools, which are driven by the drawing chain, if a friction fit between the workpiece and the drawing tools can be guaranteed by means of tong-like configurations or other measures, for example. If applicable, the drawing tools can also be driven jointly by two drawing chains that circulate in parallel, as is also known from the state of the art.

Therefore, if drawing tools comprising at least first and second drawing recesses are arranged or configured on the chain links of the drawing chain, in this regard, drawing of the corresponding workpiece through the drawing die can already be guaranteed by means of a caterpillar track configured in this manner, as long as a sufficient friction fit or force fit between the workpiece and the drawing tool can be guaranteed by means of suitable measures, as has already been indicated above.

In this regard, the drawing tools can also have first and second drawing recesses, wherein the first drawing recesses are intended for a first caliber range and the second drawing recesses are intended for a second caliber range that deviates from the first caliber range, so that a total caliber range that comprises the first and the second caliber range can be made available by means of one drawing tool, in each instance.

In this regard, the drawing recesses are preferably disposed next to one another on the respective drawing tools, with a component perpendicular to the drawing line, so that the first drawing recesses and the second drawing recesses can be aligned optionally with reference to the drawing line by means of a corresponding displacement of the respective drawing tools perpendicular to the drawing line, so as to change the caliber range accordingly between the first and the second caliber range.

Since it proves to be relatively complex to guarantee an operationally reliable and simple friction fit or force fit connection between the drawing tools that circulate with the drawing chains and the respective workpieces, which connection can furthermore be closed and opened again in correspondingly fast and operationally reliable manner when great circulation speeds are supposed to be achieved, if a drawing tool is set onto the workpiece only from one side, caterpillar tracks and corresponding caterpillar track drawing machines on which two drawing chains comprising circulating chain links, in particular, are provided, have proven to be advantageous.

The respective drawing tools, which then circulate with the drawing chains, can then be used jointly, in each instance, for the purpose of gripping the workpiece to be drawn.

If, as described above, the drawing tools of at least one of the two drawing chains comprise two drawing recesses, it can be sufficient if the drawing tools of the other of the two drawing chains merely have one drawing recess, in each instance, if this recess is suitable for being able to cover the desired caliber ranged in interplay with the two drawing recesses of the drawing tools of the first drawing chain, taking into consideration the positioning of the respective drawing tools with reference to the drawing line, to such an extent that the respective workpieces can be gripped sufficiently firmly without damaging them.

Then, too, the first and second drawing recesses of the first drawing chain can be optionally aligned with reference to the drawing line by means of displacements of the respective drawing tools perpendicular to the drawing line.

By means of setting the respective drawing tools in terms of their distance from the drawing line, the final caliber can then be selected accordingly with reference to the respective workpiece.

In particular, drawing tools comprising at least two drawing recesses can also be arranged or configured on the chain links of the second drawing chain. In this manner, coordination of the final caliber with reference to the workpieces can turn out to be even more precise, and accordingly, this increases the operational reliability in the case of gripping of the workpieces and/or minimizes the risk of damage to the workpieces. If, however, the drawing recesses of the second drawing chain deviate from the drawing recesses of the first drawing chain or deviate at least perpendicular to the drawing line, in this manner the entire calibration range that can be covered by the respective set of drawing tools can be enlarged accordingly, if the respective drawing recesses are coordinated with one another in suitable manner.

At least, the drawing recesses of the second drawing chain can be disposed perpendicular to the drawing line, deviating from the first drawing recesses of the first drawing chain; it is assumed that this should reduce the total wear, since different regions, in each instance, of the caterpillar track or of the caterpillar track drawing machine are subject to stress when a change in caliber occurs.

Accordingly, it is advantageous if the drawing recesses of the second drawing chain are also arranged next to one another perpendicular to the drawing line, in each instance, or with reference to a drawing plane that intersects the drawing line, so that the drawing recesses of the second drawing chain can optionally be aligned jointly with the respective chain link with reference to the drawing line, by means of displacement of the respective drawing tools perpendicular to the drawing line, so as to change the calibration range accordingly between the two calibration ranges. This can be done, in particular, as has already been indicated above, with a direction component that deviates from the direction component with which the drawing tools and chain links of the first drawing chain were aligned so as to achieve the desired total caliber.

In general, not only does a material redistribution perpendicular to the drawing line take place during shaping, when the workpiece is drawn through the drawing die, but also stretching of the workpiece takes place, so that material is also redistributed along the drawing line. This holds true, in particular in the case of drawing processes of metallic tubes or rods or posts. On the other hand, drawing machines for cables, for example, are also known, in the case of which merely transport or shaping only perpendicular to the drawing direction, for example for redistribution of the individual filaments of a cable, stands in the foreground.

In the present case, the caterpillar track drawing machine is particularly suitable, in particular due to the relatively great shaping forces that can be applied by it, for shaping processes in which a material distribution takes place not only perpendicularly but also along the drawing line. Accordingly, the present caterpillar track drawing machines or the corresponding caliber changing methods are particularly suitable for tubes, rods or posts to be shaped, preferably for corresponding metallic tubes, rods or posts to be shaped.

It is understood that preferably, the drawing tools of both drawing chains can each be aligned, together with the respective chain link, perpendicular to the drawing line; this—as has already been explained above—accordingly increases the flexibility and/or the size of the total caliber range that can be covered in this manner.

If the two drawing recesses of the second of the two drawing chains are intended for caliber ranges that deviate from the first and second caliber ranges of the first of the two drawing chains, a large caliber range, in particular, can be made available by the respective set of drawing tools. Alternatively to this, it is possible to configure the individual drawing recesses as similarly as possible with reference to the most optimal shaping of this drawing recess, so as to be able to grip the workpieces as gently as possible and nevertheless in sufficiently operationally reliable manner in this way.

Correspondingly great flexibility or a correspondingly great total caliber range can be achieved, in particular, if all the drawing recesses of the first of the two drawing chains deviate from the drawing recesses of the second of the two drawing chains.

In general, a drawing plane can be assigned to the respective caterpillar track, in which plane the drawing line lies. In this regard, the drawing plane then also comprises the drawing line.

Since the chains generally circulate in a plane that can be assigned to them, the drawing plane can be laid, at least with reference to one of the drawing chains, parallel to the plane in which this drawing chain circulates. Chain wheels that might be present will then also be disposed parallel to this drawing plane.

If only two drawing chains are used in the case of the corresponding caterpillar track, then these will generally be arranged to lie opposite one another, if only so as to distribute the forces that occur as uniformly as possible. The related drawing planes then meet at the drawing line and lie one above the other. If, however, three drawing chains are used, for example, which are arranged around the drawing line by an angle of 120°, in each instance, then the drawing planes also meet or intersect at the drawing line, without overlapping. However, arrangements having multiple drawing planes have proven to be structurally relatively complex and therefore also relatively cost-intensive and complicated in operation.

Accordingly, it is advantageous, in particular, if two drawing chains are used for the caterpillar track, which chains are guided parallel to a drawing plane that comprises the drawing line.

In this regard, accordingly, at least one chain wheel and, in particular, two chain wheels will also be present per drawing chain, which are also arranged parallel to the drawing plane and around which the drawing chains are guided. Depending on the concrete embodiment, the chain wheel or the chain wheels is/are aligned parallel to a drawing plane that intersects the drawing line, so that the respective drawing chains circulate parallel to this drawing plane and preferably actually circulate in this drawing plane. In this regard, the chain wheels themselves can also have a more complex structure and can comprise multiple chain rings, for example, disposed parallel to one another with reference to the axes of the chain wheels, which rings engage into the drawing chains, in each instance, or guide them accordingly.

One of these chain wheels or even both of these chain wheels are generally also used to drive the chains, so as to apply the corresponding drawing forces in this way.

Preferably, alignment of the drawing tools and chain links of the drawing chains so as to change between the first and the second caliber range is provided jointly with the chain wheel or the chain wheels; this can be implemented structurally in particularly simple manner. The latter holds true, in particular, if the chain wheels are disposed on a chain support that preferably also fulfills further guidance tasks, in particular for the respective drawing chain. Then it is possible to carry out corresponding displacement, so as to change the caliber range accordingly, between the first and the second caliber range, jointly with this chain support, in that the entire chain support is displaced accordingly. It is understood that a displacement of the drawing tools perpendicular to the drawing plane, even independent of whether the drawing plane is defined by way of chain wheels or by means of other geometric arrangements, such as the circulation plane of the drawing chains, or whether the chain wheels or a chain support are also displaced, can be advantageous accordingly.

In this regard, it is also conceivable that specific modules, such as idle rollers, idle roller chains or press-down bars, are not also displaced. In particular, it might then be practical to relax the respective drawing chain before aligning it and tighten it again after aligning it, so as to facilitate alignment relative to these modules. The latter also holds true if alignment does not take place by means of simultaneous displacement of the entire chain but rather if the chain is displaced locally by means of a lateral offset, for example, and then the corresponding lateral displacement takes place successively as the chain circulates, until then, at the end, all the chain links and thereby also the corresponding drawing recesses are aligned in the desired manner with reference to the drawing line.

In the present case, it appears to be particularly advantageous that the drawing line does not need to be changed or displaced during alignment of the drawing tools or of the drawing recesses and of the chain links with reference to the drawing line, so that displacement of the drawing die, on the one hand, but also displacement of other assemblies that work together with the caterpillar track drawing machine and enter into interaction with the workpieces before and after drawing, such as for de-scaling, rectification, or cutting to length, before and after drawing, do not also have to be moved.

Preferably, the caterpillar track drawing machine has a drawing die support that carries the drawing die, and a chain support that carries at least one of the chains or at least related chain guides, and as such represents part of the caterpillar track. In this regard, the chain support can preferably be displaceable by means of an axial drive for axial displacement of the chain support perpendicular to the drawing line, so that in this way, the related drawing chain can be displaced accordingly with reference to the drawing die support. Such an axial drive makes simple and targeted displacement of the respective chain links possible, and therefore also of the related drawing tools, so as to be able to align the respective drawing recesses accordingly in this manner.

As has already been indicated above, the drawing tools can be arranged or configured on the chain links. If the drawing chains comprise blocks, it proves to be advantageous to arrange or configure the drawing tools on the blocks of the drawing chain, as is disclosed, for example, in EP 2 197 601 B1 or also in specific exemplary embodiments of WO 2006/002613 A1 or in DE 10 2018 111 731 A1. On the other hand, separate drawing tools, which are merely attached to plate links of the drawing chains can be provided, as is disclosed in JP 2 986 758 B2 or also specific exemplary embodiments of WO 2006/002613 A1. In particular, the drawing recesses can be configured in the blocks of the drawing chain or one of the drawing chains, since the chain links, and therefore also the blocks as chain links, are supposed to be displaced jointly with the drawing tools, so that structural separation is not compulsorily necessary. Accordingly, in a particularly preferred embodiment, it is possible to do without a separately configured tool holder that is provided or configured on the respective chain links, in other words, for example, on the blocks, so that the respective chain links and the drawing tools, and, if applicable, also the tool holders can be configured as a structural unit or in one piece.

It is understood that—depending on the concrete embodiment—the caterpillar track drawing machine can also comprise multiple drawing dies, through which the caterpillar track then draws the corresponding workpiece successively.

Likewise, it is understood that—depending on the concrete embodiment—the two drawing recesses of one or of all the drawing tools of one or of both of the drawing chains can be assigned to identical caliber ranges, if this appears to be appropriate, so as to be able to change the drawing recesses rapidly in case of wear, for example, without having to replace all of the drawing tools or the drawing chain, if a caliber change as such is not required in this regard on the corresponding caterpillar track drawing machine, but the useful lifetime is supposed to be lengthened.

It is understood that the characteristics of the solutions described above and in the claims can also be combined, if applicable, so as to be able to implement the advantages cumulatively, accordingly.

Figure 2:
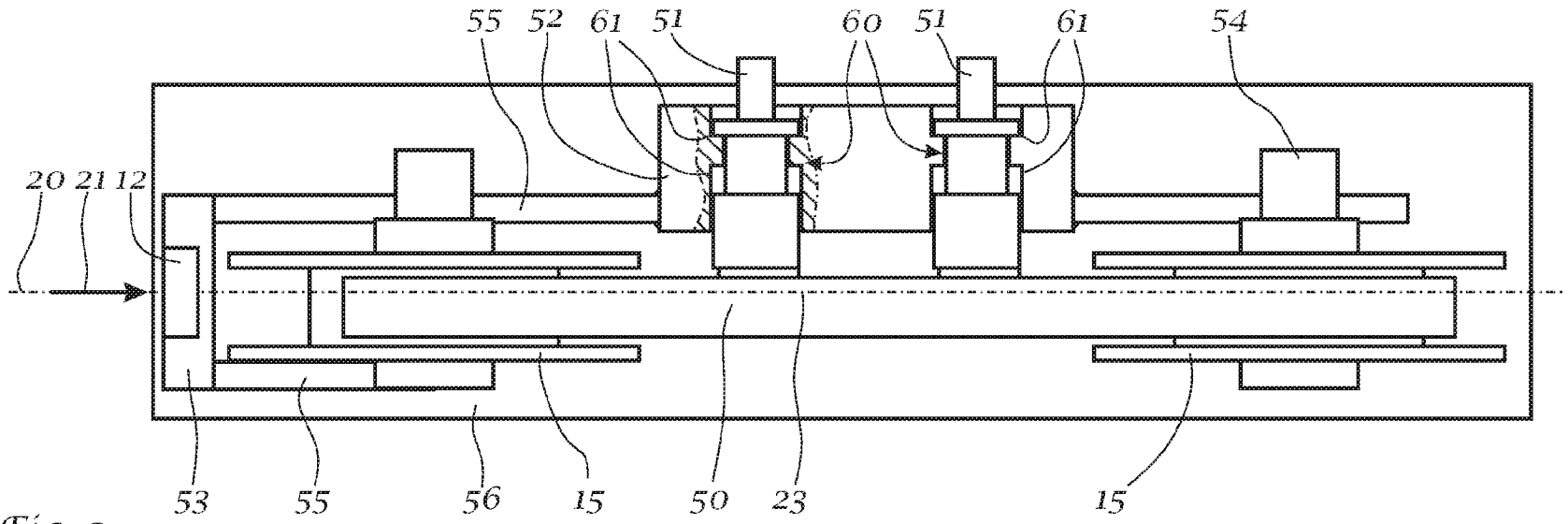
Figure 3:
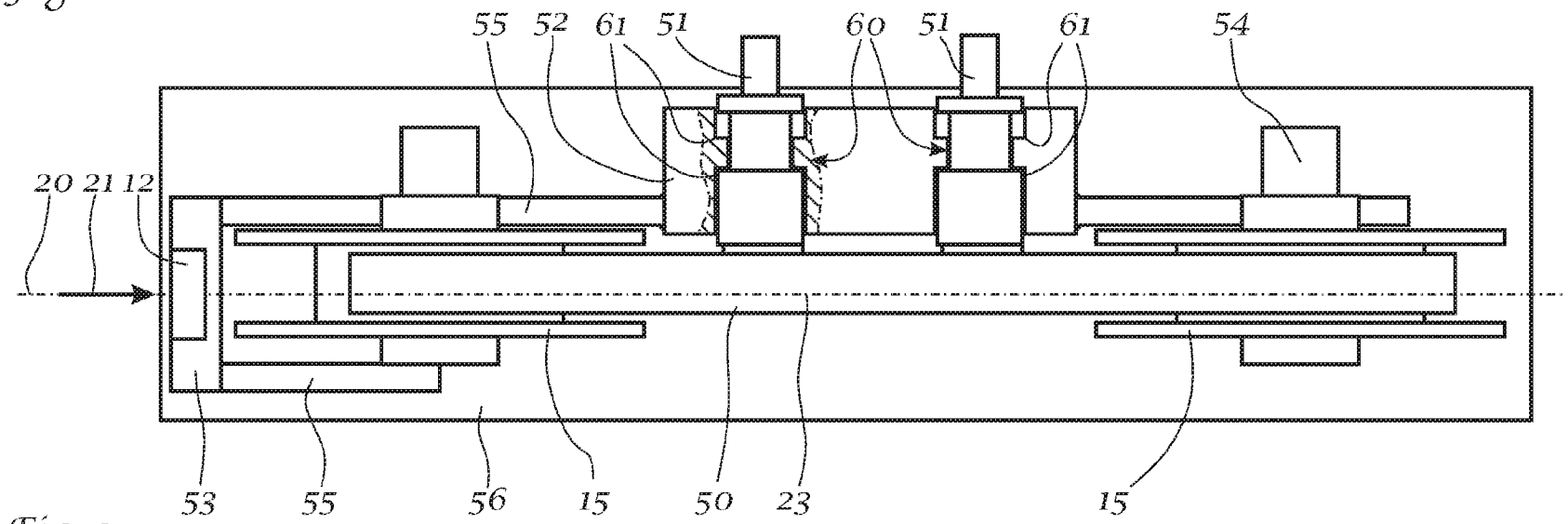
Figure 4:
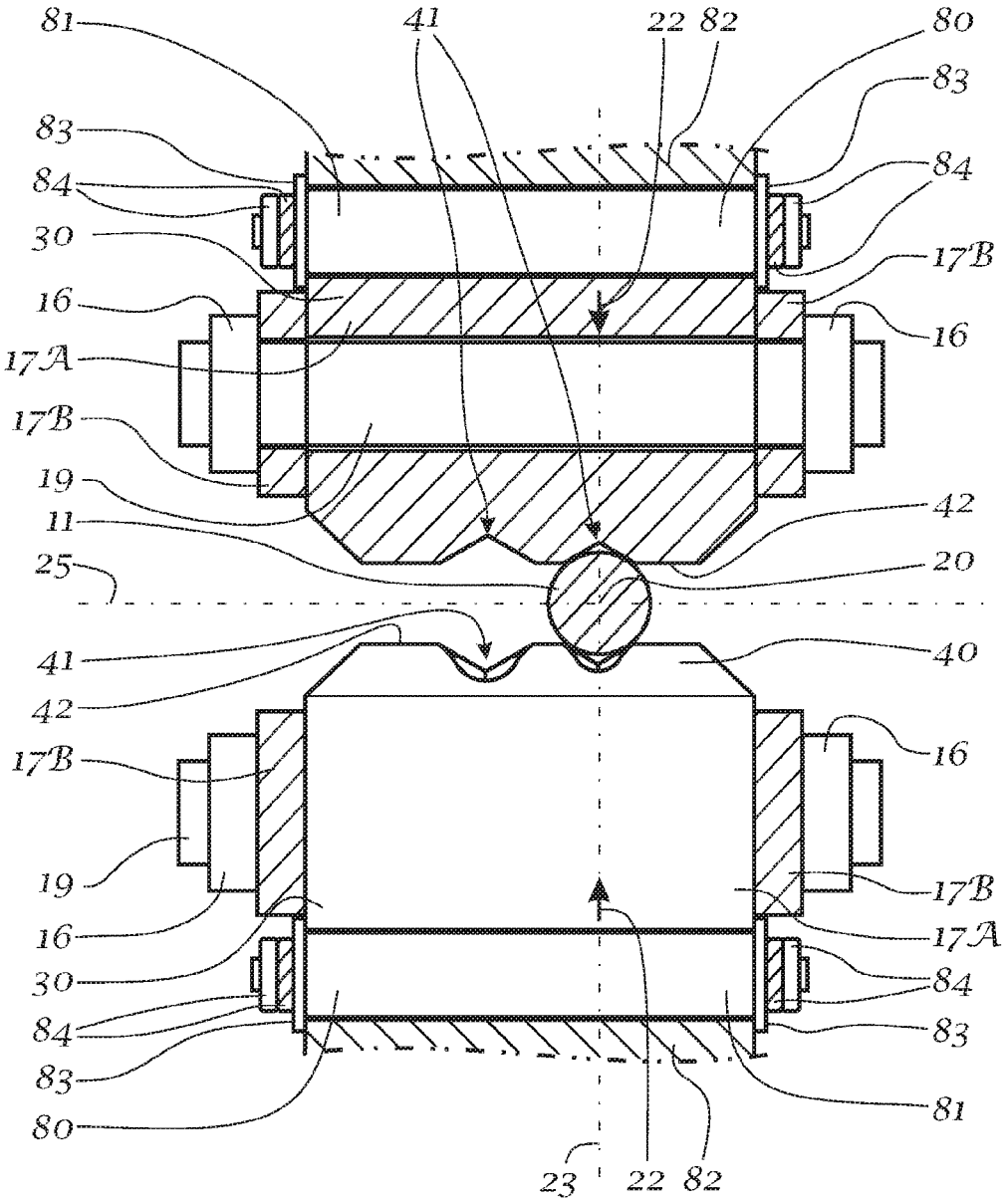
Figure 5:
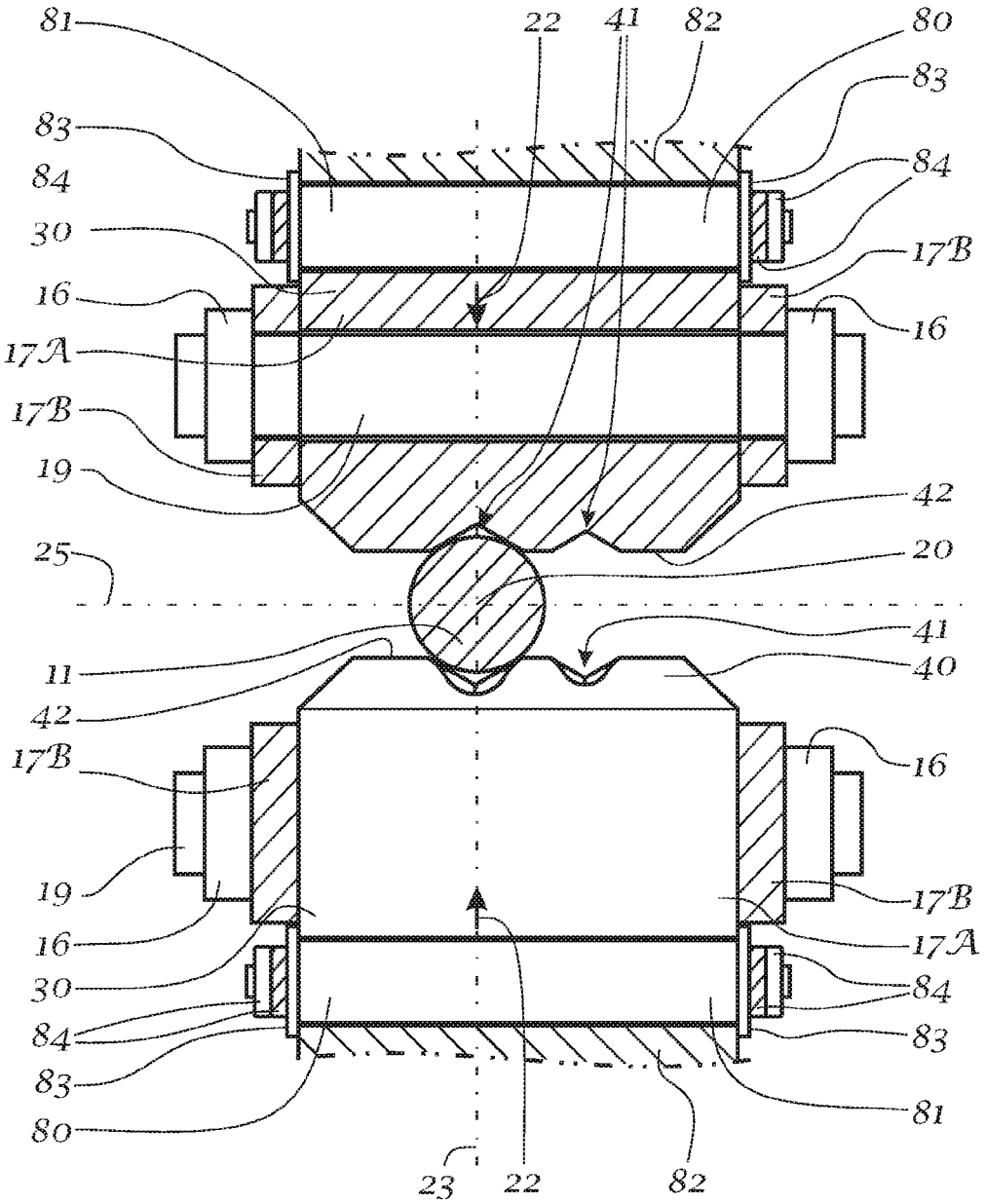
Figure 6:
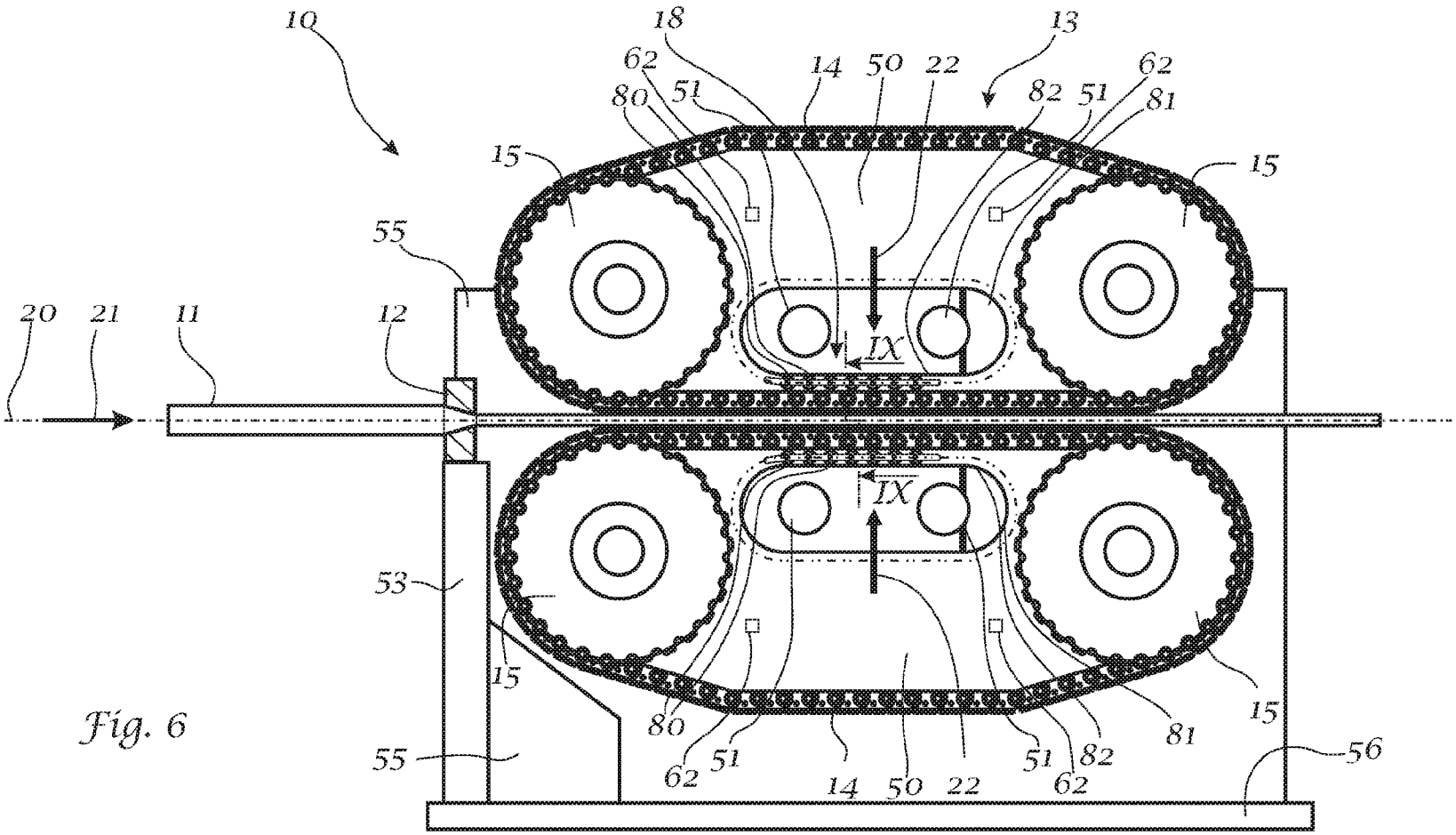
Figure 7:
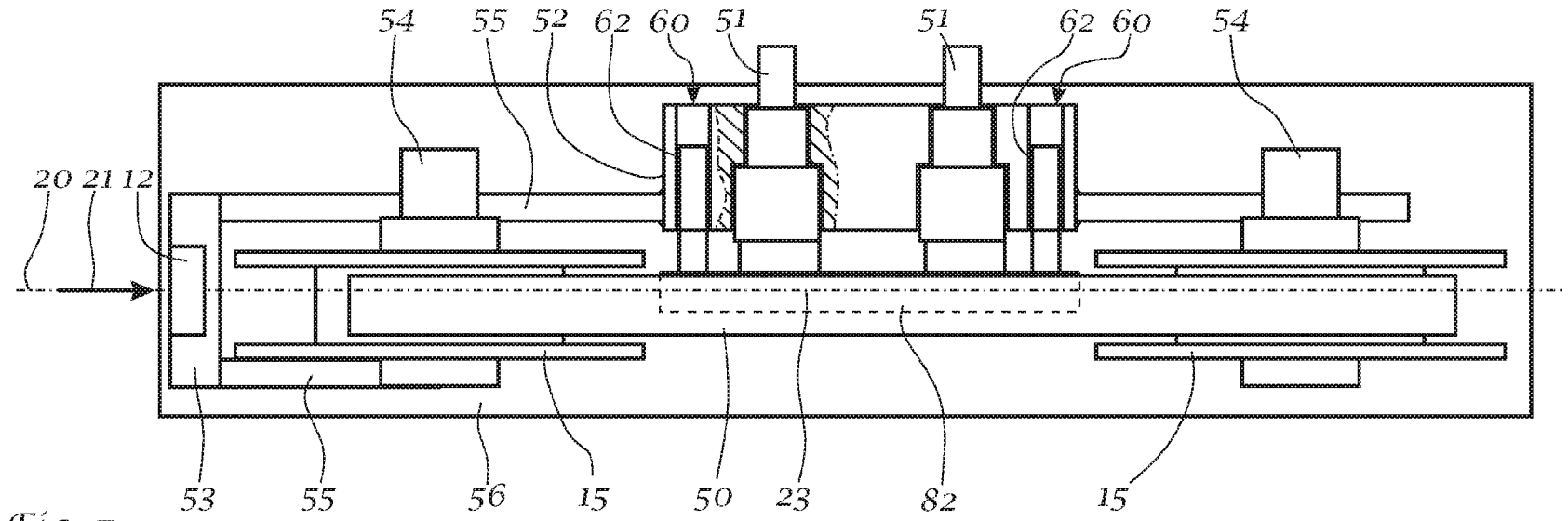
Figure 8:
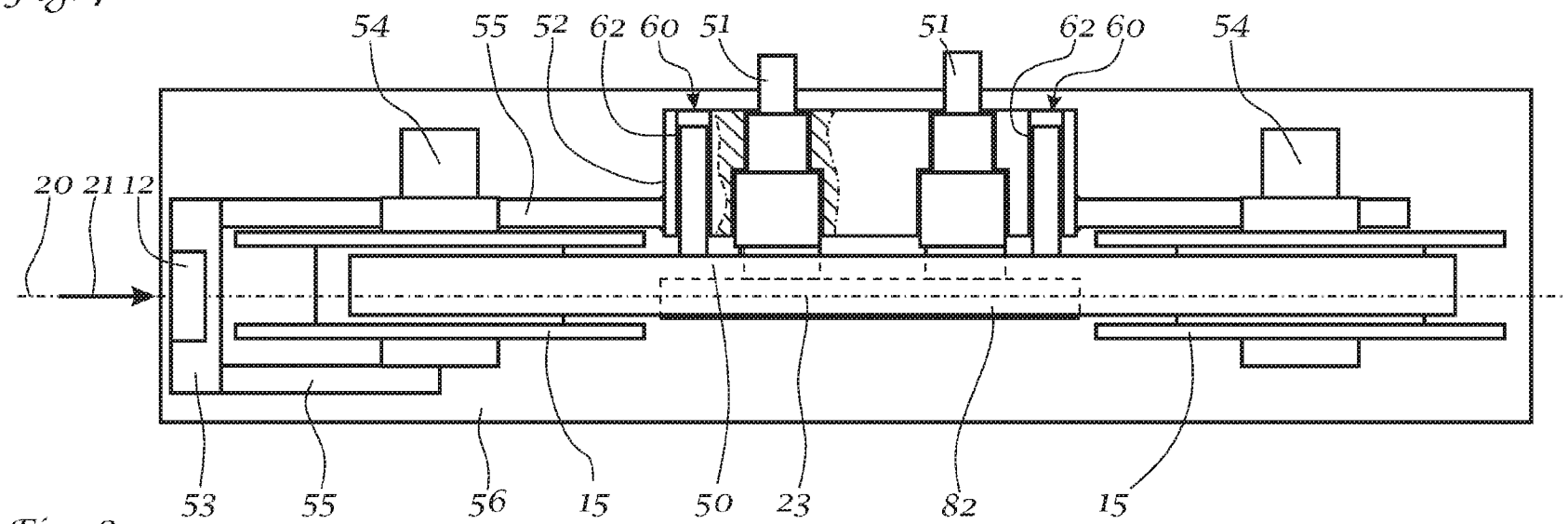
Figure 9:
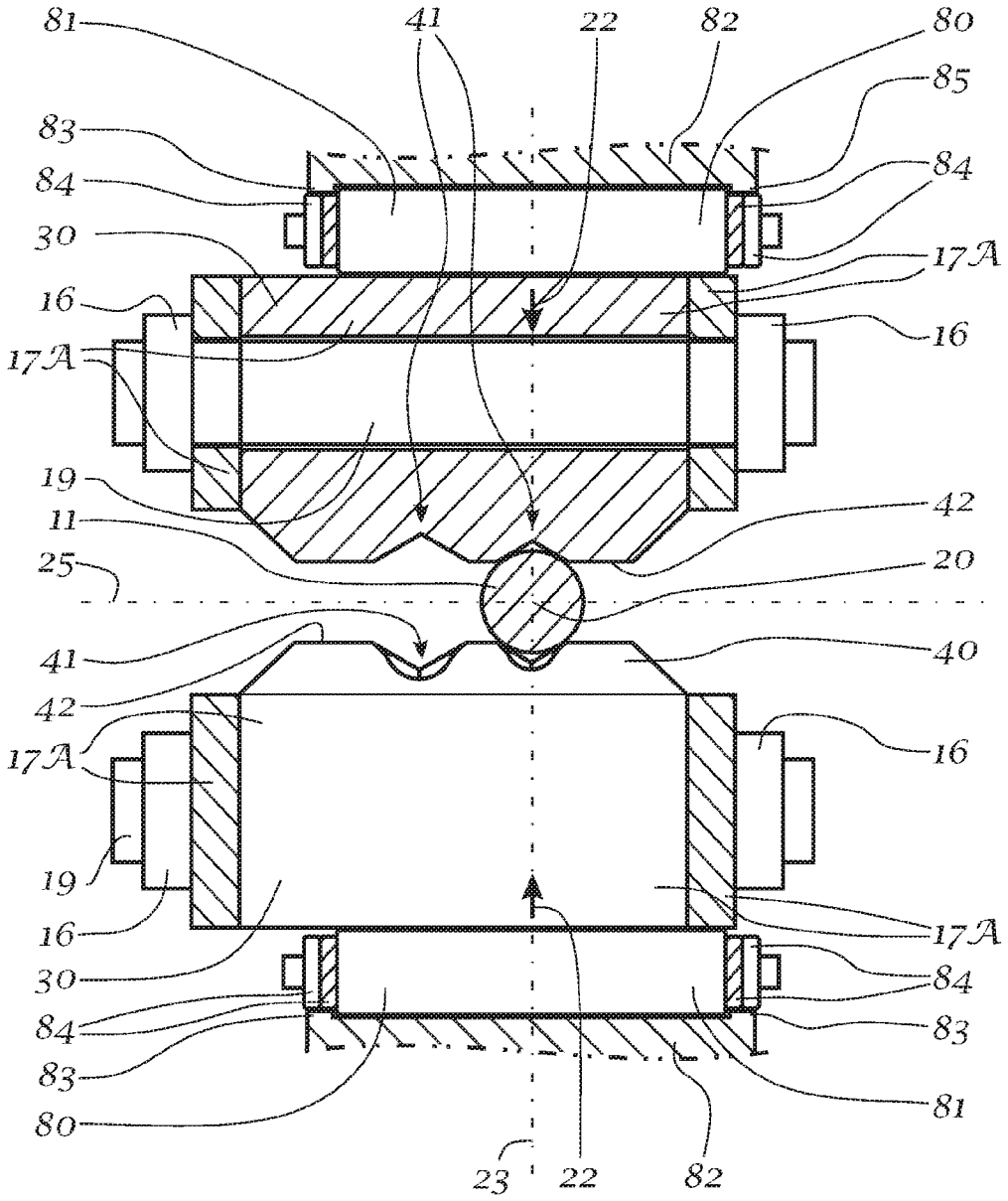
Figure 10A:
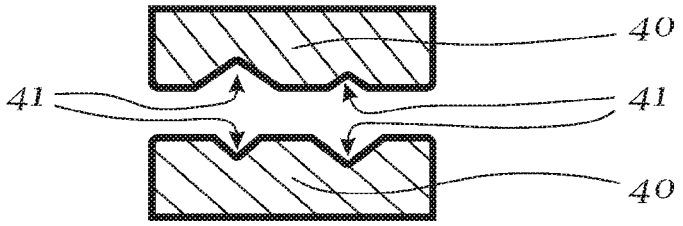
Figure 10B:
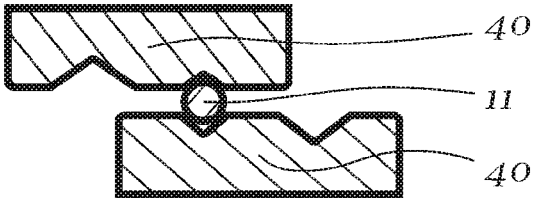
Figure 10C:
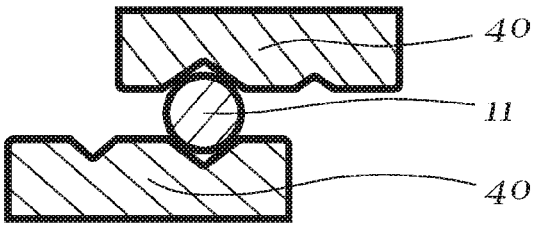
Figure 10D:
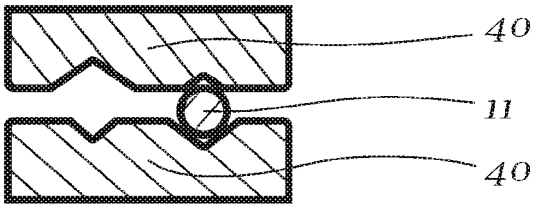
Figure 10E:
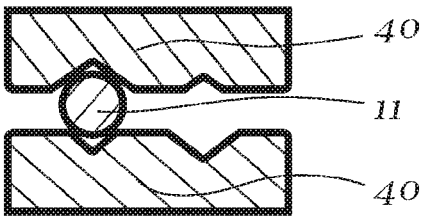
Figure 11A:
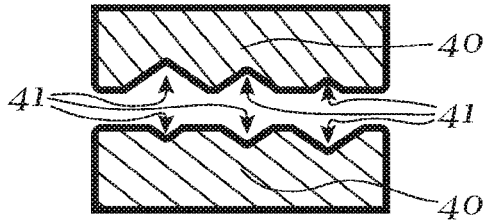
Figure 11B:
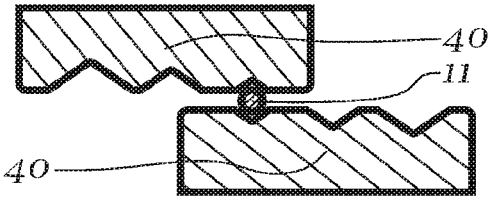
Figure 11C:
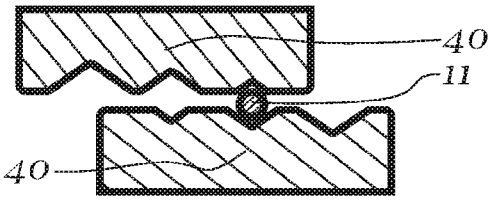
Figure 11D:
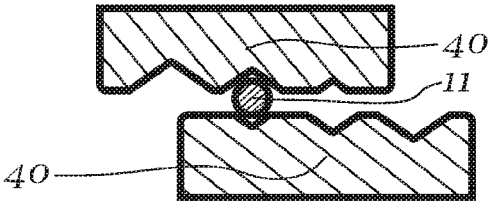
Figure 11E:
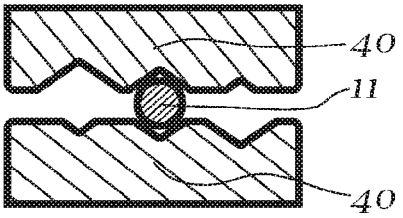
Figure 11F:
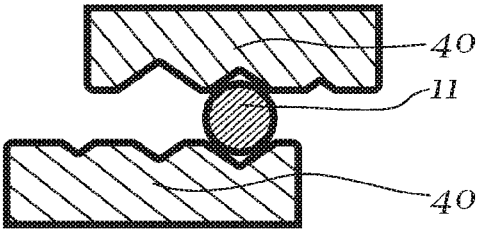
Figure 11G:
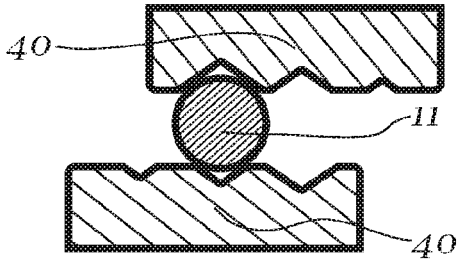
Figure 11H:
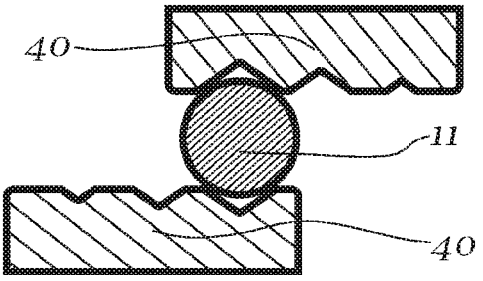
Figure 12:
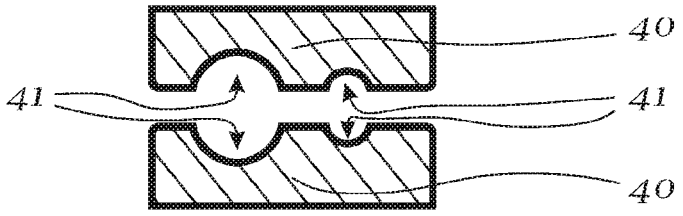
Figure 13:
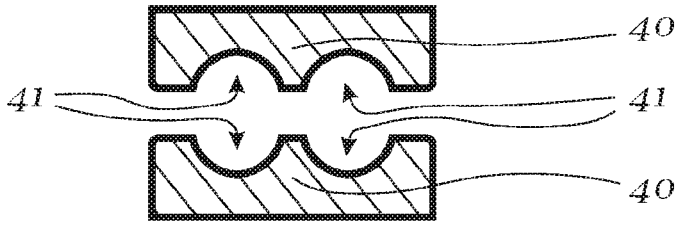

Further advantages, goals, and properties of the present invention will be explained using the following description of exemplary embodiments, which are particularly also shown in the attached drawing. The drawing shows:

FIG. 1 schematically, a side view of a first caterpillar track drawing machine;

FIG. 2 a schematic top view of the first caterpillar track drawing machine according to FIG. 1, without drawing chains and without idler roller chains, in a first drawing tool alignment;

FIG. 3 a schematic top view of the first caterpillar track drawing machine according to FIGS. 1 and 2, without drawing chains and without idler roller chains, in a second drawing tool alignment;

FIG. 4 a section through the first caterpillar track drawing machine according to FIGS. 1 to 3 in its first drawing tool alignment along the line IV-IV in FIG. 1;

FIG. 5 the section according to FIG. 4 through the first caterpillar track drawing machine according to FIGS. 1 to 3 in its second drawing tool alignment;

FIG. 6 schematically, a side view of a second caterpillar track drawing machine;

FIG. 7 a schematic top view of the second caterpillar track drawing machine according to FIG. 6, without drawing chains and without idler roller chains, in a first drawing tool alignment;

FIG. 8 a schematic top view of the second caterpillar track drawing machine according to FIGS. 6 and 7, without drawing chains and without idler roller chains, in a second drawing tool alignment;

FIG. 9 a section through the second caterpillar track drawing machine according to FIGS. 6 to 8 in its first drawing tool alignment along the line IX-IX in FIG. 6;

FIG. 10 a drawing tool arrangement with drawing recesses alternative to the drawing recesses of the embodiments according to FIGS. 1 to 9;

FIG. 11 a drawing tool arrangement with drawing recesses alternative to the drawing recesses of the embodiments according to FIGS. 1 to 10;

FIG. 12 a drawing tool arrangement with drawing recesses alternative to the drawing recesses of the embodiments according to FIGS. 1 to 11; and FIG. 13 a drawing tool arrangement with drawing recesses alternative to the drawing recesses of the embodiments according to FIGS. 1 to 12.

The caterpillar track drawing machines 10 shown in the figures comprise a drawing die 12, in each instance, and a caterpillar track 13 disposed behind the drawing die 12, viewed in the drawing direction 21, and serve to draw workpieces 11 through the drawing die 12 in the drawing direction, along a drawing line 20.

For this purpose, the caterpillar track drawing machines 10 have a base plate 56, by means of which a drawing die support 54 for carrying the drawing die 12, on the one hand, and a cam support 52, on the other hand, are arranged fixed in place relative to one another. In deviating embodiments, it is possible to do without the base plate 46, if applicable, as long as the cam support 52 and the drawing die support 53 can be set into relation with one another in sufficient stable manner in some other way, for example in that the corresponding modules are fastened directly into a floor or into some other building unit. In this regard, it is understood that in deviating embodiments, the base plate 56 can carry the cam support 52 and the drawing die support 53 not directly but rather also merely indirectly, if applicable.

In order for the drawing die support 53 to be able to counter the drawing forces that occur, which the drawing die 12 introduces into the drawing die support 53 and which the drawing die support 53 must counter by way of the base plate 56, drawing force stabilizers 55 are arranged at the side of the drawing die support 53, which stabilizers stabilize the drawing die support 53 as plate-like projections.

As can be seen, in particular, in FIGS. 2, 3, 7, and 8, the drawing force stabilizer 55 reaches all the way to the cam support 52 on the side of the cam support 52 and actually beyond it, so as to further stabilize the entire arrangement in this manner and, in particular, also to guarantee stable support of the cam support 52 with reference to the drawing die support 53.

In the case of the present exemplary embodiments, the caterpillar tracks 13 each comprise two drawing chains 14, which circulate parallel to a drawing plane 23. In this regard, each of the drawing chains 14 is guided around two chain wheels 15, the axes of which are oriented perpendicular to the drawing plane 23.

It is understood that in deviating embodiments, even more drawing chains, which circulate correspondingly, can be provided. Thus, it is conceivable, for example, to align two drawing chains parallel to one another and allow them to circulate in parallel, in each instance, if these parallel drawing chains then jointly carry drawing tools, directly or indirectly, that accordingly circulate in parallel with the drawing chains. Also, it is conceivable to provide more than two drawing chains 14 that are aligned relative to one another with reference to the drawing line 20, for example three drawing chains 14 that are arranged at an angle of 120° around the drawing line 20, wherein then, the drawing planes to be assigned to the respective drawing chains 14 intersect in the drawing line 20. In the case of the arrangement of the present caterpillar tracks 13, the drawing planes 23 to be assigned to the respective drawing chains 14 also intersect in the drawing line 20, but this leads to superimposition of these drawing planes 23 to form the single drawing plane 23.

A plane 25 can be defined perpendicular to the drawing plane 23, which plane 25 also intersects the drawing line 20 and, in principle, represents the plane of symmetry, with regard to which the two drawing chains 14 and their chain wheels 15 are fundamentally arranged with reference to the drawing line 20.

Each of the drawing chains 14 has a press-down force applied to it, at least in a gripping region 18, by means of a press-down bar 82, which force has a component 22 directed at the drawing line 20.

By means of the press-down force, drawing tools 40 that are arranged or configured on chain links of the drawing chains 14 can be pressed against a tool 11 situated on the drawing line 20, so as to guarantee a sufficient friction fit or force fit in this manner, which allows drawing the corresponding workpiece 11 through the drawing die 12.

During this drawing, the drawing die 12 can then act on the corresponding workpiece 11, shaping it, wherein during this shaping process, at least a material distribution of the material of which the workpiece 11 consists takes place in a plane perpendicular to the drawing line 20, wherein preferably, the redistribution actually takes place along the drawing line 20, so that the workpiece is also stretched during the drawing process.

In this way, it is particularly possible to work rods, tubes or posts, in particular metallic rods, tubes or posts, shaping them.

The drawing chains 14 of the exemplary embodiment shown in FIGS. 1 to 5 are configured as block/plate-link chains and comprise blocks 17A, plate links 17B, as well as pins 19 as chain links.

Deviating from this, the drawing chains 14 of the exemplary embodiment shown in FIGS. 6 to 9 are configured as block chains and comprise only blocks 17A and pins 19 as chain links.

The remaining chain links are connected with one another in articulated manner by way of the pins 19 of the respective drawing chains 14.

It is understood that in deviating exemplary embodiments, more complex chains or double chains and the like can accordingly be used as drawing chains 14.

In the case of the present exemplary embodiments, the pins 19 each carry chain rollers 16, which can engage into chain wheel rings of the chain wheels 15, so that the drawing chains are guided around the chain wheels 15, in each instance, and can also be driven by them, if applicable.

The caterpillar track 13 of the exemplary embodiment shown in FIGS. 1 to 5 has a chain drive 54 per drawing chain 14, which engages on the chain wheel 15 that lies at the back in the drawing direction 21, in each instance, and drives the respective drawing chain 14 in this manner.

In the case of the exemplary embodiment shown in FIGS. 6 to 9, in contrast, two chain wheels 15 of the drawing chains 14, in each instance, are driven by means of a chain drive 54, and this allows somewhat more uniform application of the drawing forces required for drawing.

It is understood that in deviating embodiments, the types of drive can also be exchanged between these two exemplary embodiments.

In the case of the present exemplary embodiments, the drawing tools 40 are configured in the blocks 17A of the drawing chains 14, in each instance. In this regard, in the case of the present exemplary embodiments, the drawing tools 40 and the blocks 17A as well as the tool holders 30 that hold the drawing tools 40 on the chain links are configured in one piece.

It is understood that the drawing tools 40 can also be configured by the blocks 17A as separate modules in deviating embodiments, as is sufficiently known from the state of the art. However, this requires a somewhat greater construction effort, since then the corresponding blocks must be configured as tool holders 30 and correspondingly holding devices must be provided on the tool holders 30 and/or on the drawing tools 40. On the other hand, this allows replacement of the drawing tools 40 if they were to wear out.

It is also understood that in deviating embodiments separate tool holders 30 can be provided, if necessary, which can then be provided on or affixed onto chain links, for example blocks, plate links or pins of the corresponding drawing chains 14, so as to hold the drawing tools 40 accordingly. Here, too, it might be conceivable to structure the tool holders 30 and the drawing tools 40 in one piece.

The drawing tools 40 of all the exemplary embodiments have at least two drawing recesses 41 on their sides of the respective drawing tool 40 arranged perpendicular to the drawing plane 23 and directed at the plane 25. In this regard, the drawing recesses 41 of the respective drawing tool 40 are intended for different caliber ranges, in each instance, so that in total, a relatively great total caliber range can be covered by these drawing tools 40.

In this regard, the drawing recesses 41 are configured, in terms of their cross-section, in such a manner that if they are pressed down against a workpiece 11 that is situated within the caliber range for which the corresponding drawing recess 41 is intended, sufficiently great press-down forces having a force-fit or friction-fit effect are applies so that the drawing chains 14 can draw the workpiece 11 through the drawing die 12, without the workpiece 11 being impaired to a critical degree, for example damaged or deformed.

As has already been explained above, these press-down forces are made available by means of press-down bars 82, wherein for this purpose, the press-down bars 82 can be moved toward the drawing line 20 or away from it, parallel to the drawing plane 23, using cams 51.

The cams 51 are mounted in the cam support 52 so as to be able to counter not only the corresponding press-down forces but also the corresponding drawing forces.

It is understood that in deviating embodiments, other devices, such as, for example, linear drives driven by an electric motor, if applicable in combination with suitable gear mechanisms, levers and/or guides, can be used instead of the cams 51, in order to apply the required press-down forces perpendicular to the plane 25 or in the respective drawing planes 23. Accordingly, alternative suitable supports are then used instead of the cam supports 52; these supports stand in a spatial relationship with the respective drawing die supports 53 and carry the corresponding devices and absorb the corresponding press-down forces and also the drawing forces, if applicable.

In the case of the present exemplary embodiments, the drawing chain 14 and the related chain wheels 15 are disposed on chain supports 50, in each instance, which are carried by the cams 51, wherein this is done directly by way of the cams 51 in the case of the exemplary embodiment according to FIGS. 1 to 5, and the respective chain supports 50 also carry or form the press-down bar 82. In the case of the exemplary embodiment shown in FIGS. 6 to 9, in contrast, the press-down bar 82 is configured as a separate module and carried directly by the cams 51, so as to apply the related press-down forces, while then, the related chain support 50 is carried in displaceable manner. It is understood that in this regard, depending on the concrete requirements, the concrete embodiment of chain support 50 with reference to the press-down bar 82 and with reference to the cams 51 or other devices that apply the press-down forces can be adapted or replaced.

In order to meet the press-down forces that the press-down beam 82 is supposed to exert on the drawing tools 40, idle rollers 80 are provided in the case of the exemplary embodiments according to FIGS. 1 to 9, in each instance, which rollers are arranged in idle roller chains 81, in each instance, and run past or circulate around the press-down bars 82 jointly with the respective drawing chains 14 but at a deviating running speed.

In this regard, the idle roller chains 81 are configured as plate link chains, on the pins of which the idle rollers 80 are disposed, in each instance, wherein the plate links 84 of the idle roller chains 81 are disposed on both sides of the idle rollers 80, in each instance.

In the case of the exemplary embodiment according to FIGS. 1 to 5, the idle roller chains 81 also carry guide disks 83, which are provided between the plate links 84 and the idle rollers 80 in the case of this exemplary embodiment, and which project beyond the running path of the idle rollers 80. Both the idle rollers 80 or the idle roller chains 81, on the one hand, and—indirectly—the drawing chains 14 or the chain links of the drawing chain 14, on the other hand, are guided with reference to the drawing plane 23, perpendicular to the drawing plane 23 by means of these plate links 84.

Guidance of the drawing chains 14 or of the chain links of the drawing chains 14, perpendicular to the drawing plane 23, by way of the press-down bar 82, is not provided for in the exemplary embodiment shown in FIGS. 6 to 9, in which the idle rollers 80 or the idle roller chains 81 are guided by way of lateral idle roller guides 85, which are provided on the press-down bars 82 and engage around the idle rollers on the side, parallel to the drawing plane 23, in each instance. In the case of this exemplary embodiment, guidance of the drawing chains 14 takes place, with reference to the drawing plane 23, by means of the chain wheels 15 and/or—if applicable—external lateral guides not shown separately here, which are provided, for example, on the chain supports 50 or even entirely independent of them. Such an embodiment makes it possible to displace the drawing chains 14 perpendicular to the respective drawing plane 23 with reference to the idle rollers 80 or with reference to the press-down bars 82, if this is desired—as will still be explained in greater detail below. It is understood that if a corresponding displacement with reference to the idle rollers 80 or to the press-down bar 82 is not desired, corresponding guides such as those that engage around the idle rollers 80 as idle roller guides 85 can also be provided on the chain links of the drawing chain 14 or on the tool holders 30 or on the drawing tools 40, so as to guarantee corresponding lateral guidance with reference to the drawing plane 23.

Instead of the latter guidance, here the guidance can also be provided according to the exemplary embodiment of FIGS. 1 to 5—and vice versa—if applicable.

In the case of the exemplary embodiment shown in FIGS. 6 to 9, the press-down bar 82, as a separate module, carries the idle roller chain 81, serves as a guide bar both for the idle roller chain 81 and for application of the press-down forces, and is carried directly by the cams 51, which in turn are mounted in the cam support 52.

As has already been explained above, the drawing tools 40 of the present exemplary embodiments each have at least two drawing recesses 41, which are situated parallel to the drawing line 20 and offset perpendicular to the drawing plane 23, and can optionally be aligned with reference to the drawing line 20, in each instance. This can take place, in the case of the exemplary embodiment shown in FIGS. 1 to 5, by means of corresponding displacements of the press-down bar 82 jointly with the chain supports 50, while this takes place by means of displacement of the chain wheels 15 jointly with the chain support 50 or with the lateral guides, not shown separately, in the case of the exemplary embodiments shown in FIGS. 6 to 9.

For such displacement, the exemplary embodiments of FIGS. 1 to 9 have axial drives 60, which are configured as hydraulics 61 in the case of the exemplary embodiment according to FIGS. 1 to 5 and as linear motors 62 in the case of the embodiments according to FIGS. 6 to 9. It is understood that here, too, replacement of the type of drive by other suitable drives or by one another can take place, if applicable.

In the case of the exemplary embodiment shown in FIGS. 1 to 5, the hydraulics 61 are configured directly in the cams 51 and the cam supports 52, so that here, no separate modules are required and the cams 51 themselves can be correspondingly displaced by the hydraulics 61 themselves. It is understood that in deviating exemplary embodiments, a separate axial drive 60 can also be provided, which—if applicable—also axially displaces the entire cam support 52 or a module that carries the module that applies the press-down forces, accordingly.

In the case of the exemplary embodiment shown in FIGS. 1 to 9, the drawing tools 40 of both drawing chains can be aligned jointly with the respective chain link, perpendicular to the drawing line 20 or perpendicular to the drawing plane 23. Depending on the concrete embodiments, however, it can be sufficient if only one of the two drawing chains 14 meets this requirement.

Furthermore, the drawing recesses 41 of the two drawing chains 14 are configured symmetrically with reference to the plane 25 directed perpendicular to the drawing plane 23, so that the drawing tools are displaced with identical direction components with reference to the drawing plane 23 when the caliber range is supposed to be changed. For this purpose, the drawing recesses 41 of the respective drawing tools 40 have a different cross-section, in each instance.

On the other hand, the drawing recesses can also be disposed not with mirror symmetry but rather with line symmetry with reference to the plane 25, as is shown as an example using the exemplary embodiment according to FIG. 11. If this symmetry relative to the drawing line 20 remains, displacement of the drawing tools 40 can take place in a manner similar to FIGS. 11*b* and 11*c*, so as to align the two caliber ranges in accordance with the drawing line 20, in each instance.

In particular, it is also conceivable to structure all of the drawing recesses 41 differently, in each instance, and thereby to determine them for differing caliber ranges, in each instance, as is shown in the concrete exemplary embodiment according to FIG. 11. By means of a different offset of the respective drawing tools, different drawing recesses can then be arranged with diverse caliber ranges accordingly, with reference to the drawing line 20 on which the workpiece 11 is drawn. Accordingly, two different drawing recesses 41 of the second of the two drawing chains 14 are intended for the first caliber range, for which the first drawing recesses 41 of the at least one of the two drawing chains 14 are intended.

In the case of such an embodiment, it follows that the drawing tools 40 and the respective chain links of the second drawing chain 14 are aligned with a direction component that deviates from the direction component with which the drawing tools 40 and chain links of the first drawing chain 14 are aligned, as is directly evident in the case of the transition of the arrangement according to FIGS. 11*b* and 11*c*, for example.

The same holds true even if more than two drawing recesses 41 are provided per drawing tool 40 or drawing chain 14.

It is understood that not necessarily both or all the drawing chains 14 must have multiple drawing recesses 41. Instead, it is also conceivable that here, different numbers can be provided, and, in particular, also one of the drawing chains 14 can have merely one drawing recess 41.

In the case of the concrete exemplary embodiments shown in FIGS. 10 and 11, all the drawing recesses 41 of the respective drawing chains 14 deviate from one another. It is understood that here, the drawing tools 40 can be used jointly or in one piece with the chain links or also separately, wherein for the latter, corresponding tool holders 30 as well as suitable holding devices should preferably be provided on the tool holders 30 and the drawing tools 40, in each instance, as well.

The drawing recesses 41 shown in FIGS. 12 and 13 are suitable, in particular, for tubes, wherein ultimately, here, too, the drawing tools 40 can be used jointly or in one piece with the chain links or also separately.

In the case of the drawing tools 40 shown in FIG. 13, the drawing recesses 40 are designed for identical calibers, so that here, instead of a caliber change, wear, for example, can be countered by means of displacement or alignment of the drawing tools 40, without the drawing tools 40 or even the drawing chains 14 having to be replaced right away.

REFERENCE SYMBOL LIST

10 caterpillar track drawing machine
11 workpiece
12 drawing die
13 caterpillar track
14 drawing chain
15 chain wheel
16 chain roller
17A block of the drawing chain 14
17B plate link of the drawing chain 14
18 gripping region
19 pin of the drawing chain 14
20 drawing line
21 drawing direction
22 component of the press-down force directed at the drawing line 20
23 drawing plane
25 plane directed perpendicular to the drawing plane 23
30 tool holder
40 drawing tool
41 drawing recess
42 side of the drawing tool 40 arranged perpendicular to the drawing plane 23 and directed at the plane 25
50 chain support
51 cam
52 cam support
53 drawing die support

54 chain drive
55 drawing force stabilizer
56 base plate
60 axial drive
61 hydraulics
62 linear motor
80 idle roller
81 idle roller chain
82 press-down bar
83 guide disk
84 plate link of the idle roller chain 81
85 idle roller guide

The invention claimed is:

1. A caliber changing method for changing a caliber range of a drawing chain of a caterpillar track drawing machine between a first caliber range and a second caliber range deviating from the first caliber range, wherein the caterpillar track drawing machine comprises chain links, a drawing die, a caterpillar track disposed behind the drawing die, viewed in a drawing direction, which caterpillar track draws a workpiece through the drawing die along a drawing line aligned parallel to the drawing direction and shapes the workpiece, and a drawing chain that comprises chain links, the method comprising the steps of:

applying a press-on force to at least a gripping region of the drawing chain via a press-on bar, wherein the press-on force has a component directed at the drawing line, arranging or configuring respective drawing tools, each comprising at least first and second drawing recesses on the respective chain links of the drawing chain, wherein the first drawing recesses are used for the first caliber range and the second drawing recesses are used for the second caliber range, displacing the respective drawings tools perpendicular to the drawing line to align either the first drawing recesses or the second drawing recesses with reference to a drawing plane that intersects the drawing line and that is parallel to a plane in which the drawing chain circulates, so as to change the caliber range accordingly between the first caliber range and the second caliber range, aligning the respective drawing tools jointly with the respective chain links, and arranging idle rollers in an idle roller chain and running the idle rollers past or circulating the idle rollers around the press-on bar jointly with the drawing chain at a running speed different from a running speed of the drawing chain.

2. The caliber changing method according to claim 1, further comprising the steps of relaxing the drawing chain before aligning the drawing chain and tightening the drawing chain after aligning the drawing chain.

3. The caliber changing method according to claim 1 wherein the caterpillar track further comprises a second drawing chain that comprises second chain links, and the method comprises the steps of:

applying a press-on force to at least a gripping region of the second drawing chain via a second press-on bar, wherein the press-on force has a component directed at the drawing line, arranging or configuring respective drawing tools, each (40) comprising at least two drawing recesses on the respective second chain links of this second drawing chain, wherein the drawing recesses of the second drawing chain deviate from the drawing recesses of the first drawing chain or at least are disposed in a deviating manner deviating from the first drawing chain perpendicular to the drawing line, displacing the respective drawings tools perpendicular to the drawing plane to align either the first drawing recesses of the second drawing chain or second drawing recesses of the second drawing chain with reference to a second drawing plane that intersects the drawing line and that is parallel to a plane in which the second drawing chain circulates, jointly with the respective chain link, so as to change the caliber range accordingly, between the first caliber range and the second caliber range, aligning the drawing tools and the second chain links of the second drawing chain (14) are aligned with a direction component that deviates from a direction component with which the drawing tools and chain links of the first drawing chain are aligned, and arranging idle rollers in an idle roller chain and running the idle rollers past or circulating the idle rollers around the second press-on bar jointly with the second drawing chain at a running speed different from a running speed of the second drawing chain.

4. The caliber changing method according to claim 3, wherein the two drawing recesses of the second circulating drawing chain one of the two circulating drawing chains are used for caliber ranges that differ from the first caliber range and the second caliber range ranges of the first circulating drawing chain of the two circulating drawing chains.

5. The caliber changing method according to claim 3, wherein all of the drawing recesses of the first circulating drawing chain of the two circulating drawing chains deviate from the drawing recesses of the second circulating drawing chain of the two circulating drawing chains.

6. The caliber changing method according to claim 1, wherein the drawing chains are guided or are being guided parallel to a drawing plane (23) that comprises the drawing line (20), in circulation around at least one respective chain wheel, and the drawing tools are aligned jointly with the respective chain wheel.

7. The caliber changing method according to claim 6, wherein the respective chain wheel and with it, the respective drawing chain and the respective drawing tools, to which the respective chain wheel is related are aligned via an axial drive.

8. The caliber changing method according to claim 7, wherein the caterpillar track drawing machine further comprises a chain support that comprises the respective chain wheel and the chain support and with it the respective chain wheel are aligned jointly with the drawing chain and the respective drawing tools to which the respective chain wheel is related, via the axial drive.

9. The caliber changing method according to claim 1, wherein the caterpillar track drawing machine further comprises a drawing die support and at least one axial drive for axial displacement of the drawing chain with reference to the drawing die support.

10. The caliper changing method according to claim 1, wherein the respective drawing tools are arranged or configured on blocks of the drawing chain.

11. A caterpillar track drawing machine comprising:

a drawing die;

a caterpillar track disposed behind the drawing die, viewed in a drawing direction, which caterpillar track is configured to draw a workpiece through the drawing die, along a drawing line that is aligned parallel to the drawing direction, to shape the workpiece;

two circulating drawing chains each comprising respective chain links, two press-on bars, wherein each of the two press-on bars applies a press-on force to a respective one of the two circulating drawing chains;

respective drawing tools, each comprising at least first and second drawing recesses arranged or configured on the respective chain links of at least one of the two circulating drawing chains, wherein the first drawing recesses are used for a first caliber range, and the second drawing recesses are used for a second caliber range, which deviates from the first caliber range, and wherein either the first drawing recesses or the second drawing recesses are aligned with reference to a drawing plane intersecting the drawing line and parallel to a plane in which the two circulating drawing chains circulate by displacing the respective drawing tools perpendicular to the drawing plane;

idle rollers arranged in respective idle roller chains which run past or circulate around each of the two press-on bars jointly with a respective one of the two circulating drawing chains at a running speed different from a running speed of the respective one of the two circulating drawing chains;

wherein (i) the drawing tools of at least one of the two circulating drawing chains is aligned perpendicular to the drawing plane jointly with the respective chain links, and/or wherein (ii) two different drawing recesses of a second of the two circulating drawing chains are used for the first caliber range, for which the first drawing recesses of at least one of the two circulating drawing chains are used, and/or wherein (iii) the drawing recesses of a first circulating drawing chain of the two circulating drawing chains deviate from the drawing recesses of a second circulating drawing chain of the two circulating drawing chains, or at least are arranged on their respective chain links in a deviating manner deviating from the second circulating drawing chain, perpendicular to the drawing line.

12. The caterpillar track drawing machine according to claim 11, wherein the respective drawing tools of the two circulating drawing chains are aligned jointly with each of the respective chain links, perpendicular to the drawing line.

13. The caterpillar track drawing machine according to claim 11, wherein the two drawing recesses of the second circulating drawing chain of the two circulating drawing chains are used for caliber ranges that differ from the first caliber range and the second caliber range of the first circulating drawing chain of the two circulating drawing chains.

14. The caterpillar track drawing machine according to claim 11, wherein all of the drawing recesses of the first circulating drawing chain of the two circulating drawing chains deviate from the drawing recesses of the second circulating drawing chain of the two circulating drawing chains.

15. The caterpillar track drawing machine according to claim 11, wherein the two circulating drawing chains are guided in circulation around at least one respective chain wheel and the respective drawing tools are aligned jointly with the respective chain wheel.

16. The caterpillar track drawing machine according to claim 15, wherein the at least one respective chain wheel and with it, a respective circulating drawing chain of the two circulating drawing chains and the respective drawing tools to which the at least one respective chain wheel is related, are aligned via an axial drive.

17. The caterpillar track drawing machine according to claim 16, further comprising a chain support that comprises the at least one respective chain wheel, wherein the chain support and the at least one respective chain wheel are aligned jointly with the respective circulating drawing chain of the two circulating drawing chains and the respective drawing tools to which the at least one respective chain wheel is related, via the axial drive.

18. The caterpillar track drawing machine according to claim 11, further comprising a drawing die support and at least one axial drive for axial displacement of at least one of the two circulating drawing chains with reference to the drawing die support.

19. The caterpillar track drawing machine according to claim 11, wherein the respective drawing tools are arranged or configured on blocks of a respective circulating drawing chain of the two circulating drawing chains.

* * * * *